US006779266B2

(12) United States Patent
Aghamehdi et al.

(10) Patent No.: US 6,779,266 B2
(45) Date of Patent: Aug. 24, 2004

(54) 2ND ANODE BUTTON FOR CATHODE RAY TUBE

(75) Inventors: Hossein Aghamehdi, Lititz, PA (US); Jack L. Burwick, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/651,767

(22) Filed: Aug. 30, 2003

(65) Prior Publication Data

US 2004/0097142 A1 May 20, 2004

Related U.S. Application Data

(62) Division of application No. 10/206,258, filed on Jul. 26, 2002.

(51) Int. Cl.[7] ..... H01R 43/02

(52) U.S. Cl. ..... 29/879; 29/874; 29/876; 29/878

(58) Field of Search ..... 29/874, 876, 878, 29/879

(56) References Cited

U.S. PATENT DOCUMENTS 3,584,182 A * 6/1971 Volk et al. ..... 219/87
3,648,118 A * 3/1972 Christiansen et al. ..... 361/520
4,209,895 A * 7/1980 Powell ..... 29/874
4,910,865 A * 3/1990 Houle ..... 29/825
5,519,253 A * 5/1996 Lake et al. ..... 257/724
6,373,179 B1 * 4/2002 Makienko et al. ..... 313/421
6,582,269 B2 * 6/2003 Sakai et al. ..... 445/26

* cited by examiner

*Primary Examiner*—Carl J. Arbes
(74) *Attorney, Agent, or Firm*—William H. McNeill

(57) ABSTRACT

A connecting pin (10) for an anode contact (11) (shown more completely in FIG. 2). The pin (10) has a body (12) with a longitudinal axis (14). A contact head (16) is formed at a proximal portion of the body (12) and a base (18) is formed at a distal portion of body (12). An intermediate shank (20) connects the head (16) and the base (18). The head (16), base (18) and intermediate shank (20) are all symmetrically arrayed about the longitudinal axis (14). The shank (20) has a first diameter (D,) and the contact head (16) has at least one lateral dimension (D2) that is greater than the shank diameter (D). The base (18) has a diameter (D3) that is greater than the shank diameter (D) and has a surface (22) that is planar and substantially orthogonal to the longitudinal axis (14).

3 Claims, 2 Drawing Sheets

2ND ANODE BUTTON FOR CATHODE RAY TUBE

This is a divisional of Application Ser. No. 10/206,258, filed Jul. 26, 2002.

TECHNICAL FIELD

This invention relates to electrical connectors and more particularly to such connectors for supplying anode voltage to a cathode ray tube.

BACKGROUND ART

Cathode ray tubes require numerous electrical potentials to be applied to the electrodes of the tube. One of these, the second anode, has a very high potential applied thereto, on the order of 30 kV or more ill the case of color picture tubes. This potential is conventionally applied through the funnel by a connector hermetically sealed therein. This connector conventionally is called a second anode button. It is a substantially hollow, electrically conductive button having a thermal coefficient of expansion that substantially matches that of the glass into which it is sealed. Prior to insertion the button is oxidized so that an oxide-to-oxide bond is formed with the glass.

Recently, such anode buttons have been fabricated with an external, depending connecting pin attached thereto. The pin is welded to the bottom of the anode button and projects internally of the cathode ray tube, and it is necessary that perpendicularity be achieved if the pin is to function properly.

The connecting pins are made from wire by a cold heading process that forms an enlarged head. Thereafter the opposite end of the wire is sheared to form a connecting pin of the appropriate length. This process requires a great deal of maintenance of the cut-off or shearing tool to insure a planar condition on the end of the pin so that a critical perpendicularity of the pin to the bottom of the button can be maintained.

DISCLOSURE OF INVENTION

It is, therefore, an object of the invention to obviate the disadvantages of the prior art.

It is yet another object of the invention to provide connecting pins for achieving uniform perpendicularity.

These objects are accomplished, in one aspect of the invention, by a connecting pin for an anode, the pin compromising a body having a longitudinal axis, a contact head formed at a proximal portion of the body, a base formed at a distal portion of the body and an intermediate shank portion therebetween, all symmetrically arrayed about the longitudinal axis, the shank having a first diameter, and the contact head having at least one lateral dimension greater than the shank diameter. The base has a diameter greater than the shank diameter and has a surface that is planar and substantially orthogonal to the longitudinal axis.

Providing the pin with the expanded base insures that the base will be planar and form a proper perpendicular assembly welded to the bottom of a second anode button.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
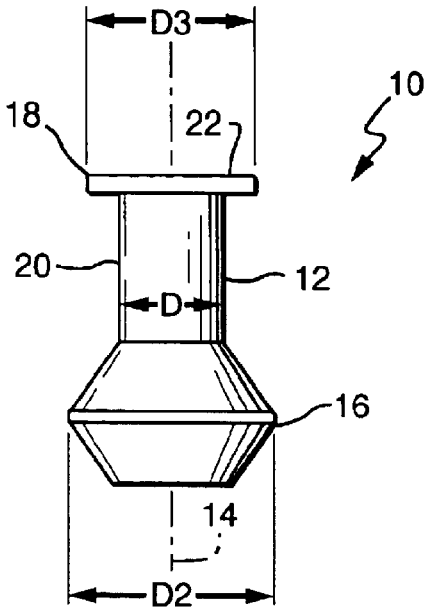
FIG. 1 is an elevational view of a connecting pin according to an aspect of the invention.
Figure 2:
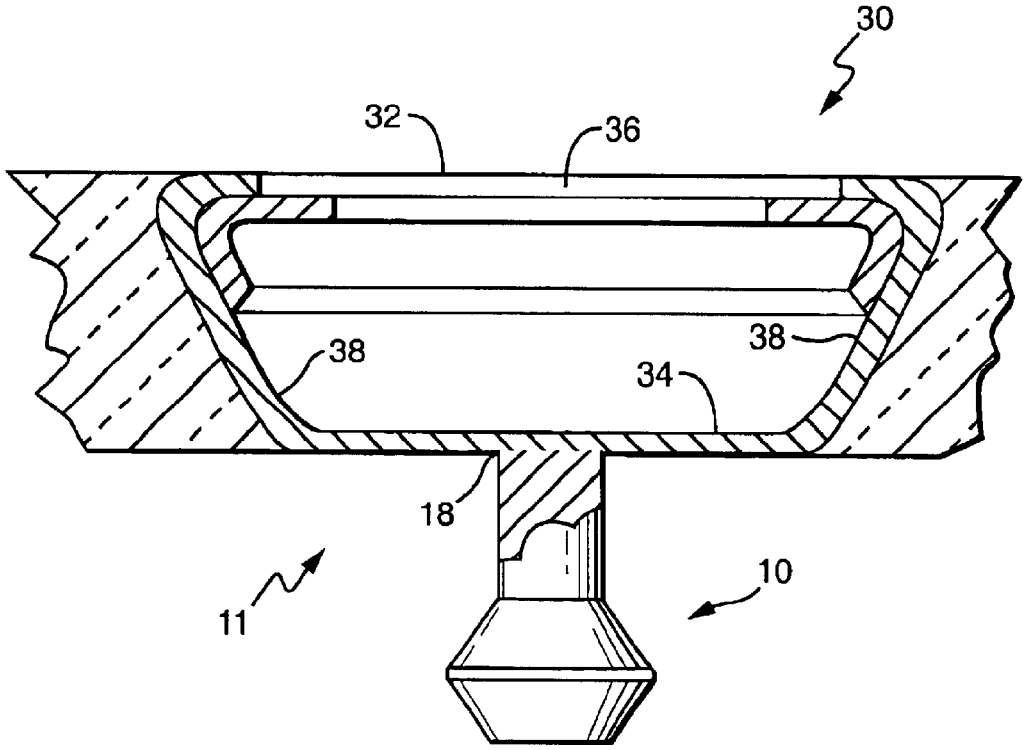
FIG. 2 is an elevational, sectional view of a pin assembled to a hollow button that is sealed into the funnel wall of a cathode ray tube.
Figure 3:
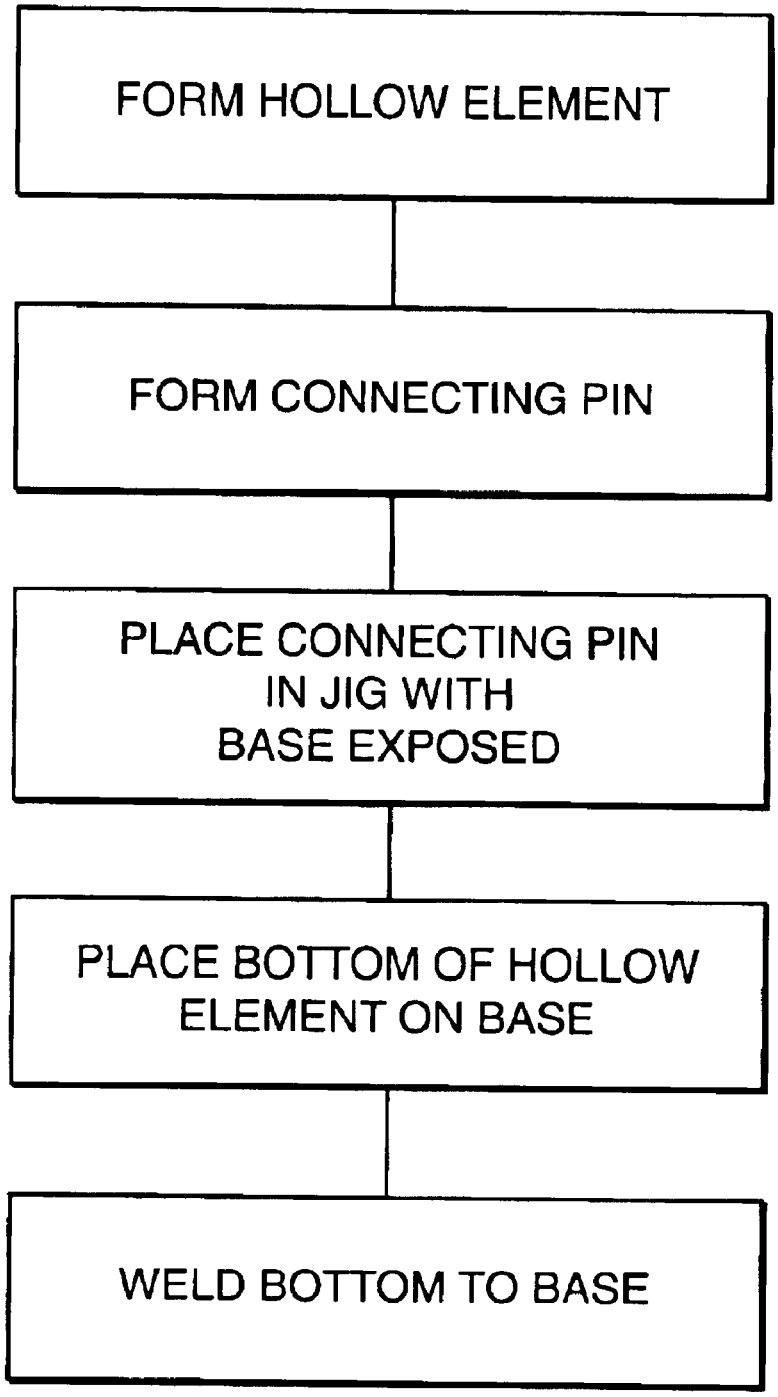
FIG. 3 is a flow diagram of the process for making the anode assembly.

Referring now to the drawings with greater particularity, there is shown in FIG. 1 a connecting pin 10 for an anode contact 11 (shown more completely in FIG. 2). The pin 10 has a body 12 with a longitudinal axis 14. A contact head 16 is formed at a proximal portion of the body 12 and a base 18 is formed at a distal portion of body 12. An intermediate shank 20 connects the head 16 and the base 18. The head 16, base 18 and intermediate shank 20 are all symmetrically arrayed about the longitudinal axis 14. The shank 20 has a first diameter D, and the contact head 16 has at least one lateral dimension D2 that is greater than the shank diameter D. The base 18 has a diameter D3 that is greater than the shank diameter D and has a surface 22 that is planar and substantially orthogonal to the longitudinal axis 14. By "substantially orthogonal" is meant perpendicularity with 2°.

The pin 10 is formed by feeding a suitable wire into a cold heading jig, forming the head 16, cutting the wire and then cold heading the terminal end of the wire to form base 18 with planar surface 22 and its diameter D3, which diameter D3 is greater than the diameter D of the shank 20.

Providing the pin 10 with the base 18 wider than the shank 20 greatly increase the welding area, provides better contact between the pin and the anode contact 11 and virtually insures perpendicularity.

The method of making an electrical contact 30, which can be an anode 11, comprises forming the hollow element 32 by steps know in the art. The element 32 has a solid bottom 34 and an apertured top 36 separated by a frusto-conical wall 38.

A formed connecting pin 10 is held in position to be welded to the bottom 34 of hollow element 32. This can be accomplished by any suitable technique, such as placing the connecting pin 10 in jig with the base 18 exposed, placing the bottom of contact 30 upon the base 18 and welding the two together. In a preferred embodiment, the welding is accomplished with laser energy and the base 18 is consumed and fused into the material of the contact 32, as illustrated diagrammatically by the cross-hatched lines in FIG. 2.

While there have be shown and described what are at present considered to be the preferred embodiments of the invention, it will be apparent to those skilled in the art that various changes and modification can be made herein without departing from the scope of the invention as defined by the appended claims.

What is claimed is:

1. A method of making an electrical contact comprised of a hollow element having a connecting pin projecting therefrom, said method comprising the steps of:

forming said hollow element with a solid bottom and an apertured top separated by a frusto-conical wall;

forming said connecting pin, said connecting pin comprising:

a body having a longitudinal axis, a contact head formed at a proximal portion of said body, a base formed at a distal portion of said body and an intermediate shank portion therebetween, all symmetrically arrayed about said longitudinal axis, said shank having a first diameter, and said contact head having at least one lateral dimension greater than said shank diameter, said base having a diameter greater than said shank diameter and having a surface that is planar and substantially orthogonal to said longitudinal axis;

placing said connecting pin in a position to be welded with said base exposed;

placing said hollow element upon said base with said solid bottom in contact with said base; and welding said bottom to said base.

2. The method of claim 1 wherein said welding occurs in a manner to substantially consume said base by fusing the material of said bottom and said base together.

3. The method of claim 2 wherein said welding is accomplished by a laser.

* * * * *